US005315935A

United States Patent [19]

Weisenfels

[11] Patent Number: 5,315,935

[45] Date of Patent: May 31, 1994

[54] FOLDING PORTABLE DRAFTING TABLE

[76] Inventor: Gilbert L. Weisenfels, Rt. 1, Box 144, Scranton, Ark. 72863

[21] Appl. No.: 973,839

[22] Filed: Nov. 2, 1992

[51] Int. Cl.[5] ..... A47B 3/00

[52] U.S. Cl. ..... 108/193; 108/115; 108/159; 312/262; 248/460

[58] Field of Search ..... 108/111, 115, 129, 159; 248/460, 174; 312/262, 231

[56] References Cited

U.S. PATENT DOCUMENTS

| | | | |
|---|---|---|---|
| 3,378,322 | 4/1968 | Johnson | 248/460 |
| 4,294,497 | 10/1981 | Daniel | 312/231 |
| 4,506,466 | 3/1985 | Hall | 108/111 |
| 4,618,120 | 10/1986 | Wattles | 248/460 |
| 4,869,564 | 9/1989 | Lechman | 108/111 |
| 4,875,418 | 10/1989 | Moeckl et al. | 108/111 |
| 5,152,491 | 10/1992 | Forster et al. | 248/460 |
| 5,224,768 | 7/1993 | Vautier | 312/262 |

FOREIGN PATENT DOCUMENTS

| | | | |
|---|---|---|---|
| 2121679 | 1/1984 | United Kingdom | 312/262 |

*Primary Examiner*—Michael Milano

*Attorney, Agent, or Firm*—Robert R. Keegan; Daniel R. Alexander

[57] ABSTRACT

A table having three major components, top, shelf and base, all constructed of light-weight wood or other light-weight materials and constructed so that the table is easily and quickly assembled and disassembled without the need for tools. All three parts simply fit together and have a handle or a hand-hole for carrying. Such a table provides art and drafting students an economical and light-weight drafting table which can be easily carried and set up. In accordance with an exemplary embodiment of the invention, the folding portable drafting table includes a folding, three panel base, a shelf adapted to be received between the panels of the base, and a removable top adapted to be placed over the base and having depending rails which form grooves therebetween adapted to receive the upper ends of the side panels of the base. The table is easily disassembled by lifting the top off the base, pulling the shelf out, and folding the side panels against the center panel of the base. The shelf and top include carrying handles, and the base includes a hand-hole for facilitating transport of the table in its disassembled form. The table is easily assembled by unfolding the base, inserting the shelf between the side panels of the base, and placing the top over the base.

10 Claims, 4 Drawing Sheets

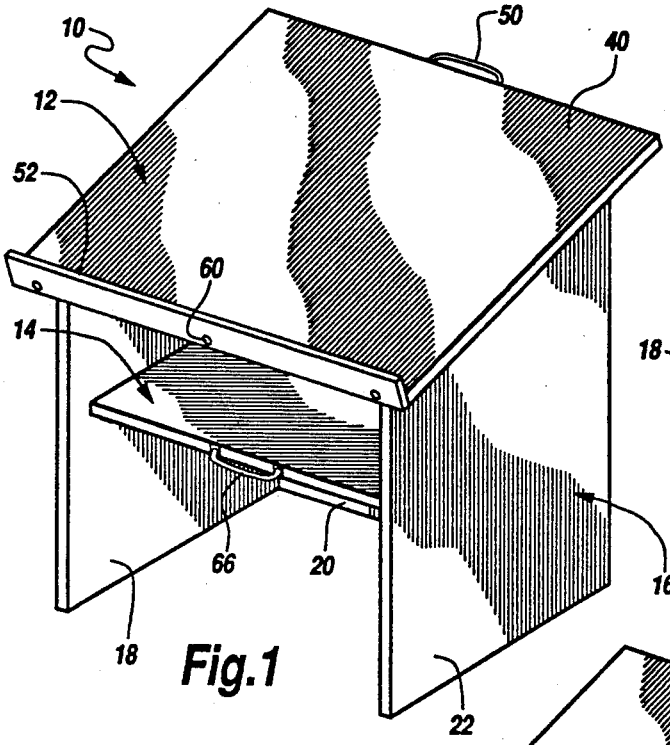
Fig.1
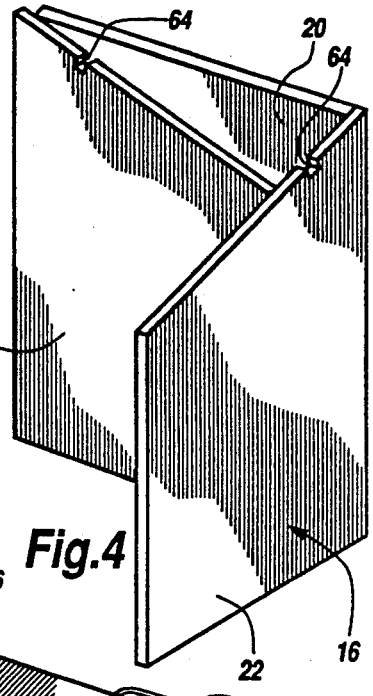
Fig.4
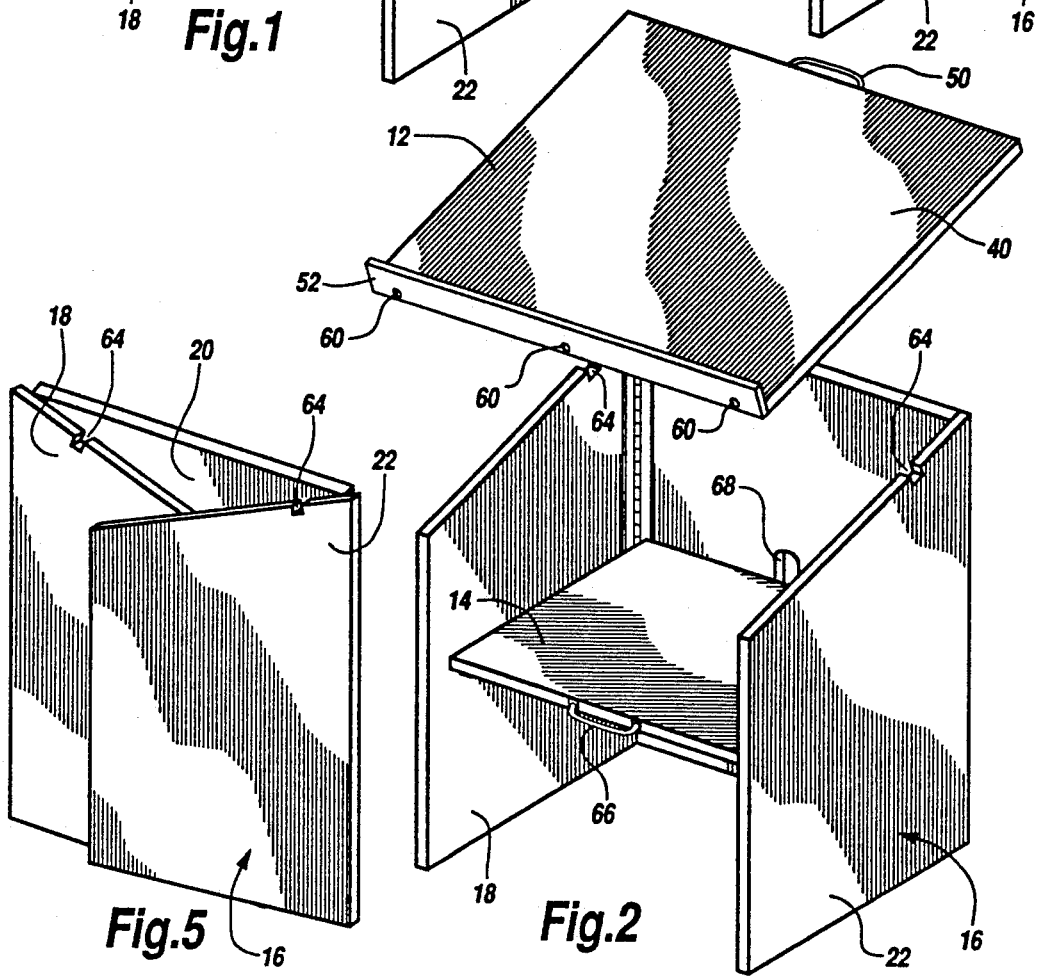
Fig.2
Fig.5

FOLDING PORTABLE DRAFTING TABLE

BACKGROUND OF THE INVENTION

The instant invention relates to the field of drafting tables, and more particularly to those that can be easily disassembled for transportation.

SUMMARY OF THE INVENTION

In accordance with the present invention, a folding portable drafting table has three parts all constructed of light-weight wood or other light material in a manner that requires no tools to assemble or disassemble quickly and easily. All parts simply fit together and have a handle or a hand-hole for carrying.

In accordance with one embodiment, the folding portable drafting table includes a base, a top, and a shelf, all made of light-weight wood or other materials. The base includes a center panel and two side panels which have slanted top edges and are joined by hinges to permit a U-shaped configuration. A width-limiting device is attached to the center panel and side panels. Shelf brackets are fastened to the interior sides of the side panels. The shelf is inserted into the open side of the base and rests on the shelf brackets. The top rests on the base and is held in place by a combination of grooves on the underside of the top. The top has a carrying handle attached to the top edge and a pencil tray on the bottom edge. The shelf has a carrying handle attached at the front edge. The base can be folded and carried by using a hand-hole in the center panel. The complete unit can be disassembled without any tools.

The object of this invention is to provide art and drafting students an economical and light-weight drafting table which can be easily carried and set up.

Other objects and further scope of the applicability of the present invention will become apparent from the detailed description to follow taken in conjunction with the accompanying drawings wherein like parts are designated by like reference numerals.

BRIEF DESCRIPTION OF THE DRAWINGS

FIG. 1 is a schematic perspective view of one embodiment of the folding portable drafting table of the present invention;

FIG. 2 is an exploded perspective view showing the removal of the top from the drafting table of FIG. 1;

FIG. 4 is a perspective view of the partial folding of the side panels of the drafting table base;

FIG. 5 is a perspective view of the apparatus of FIG. 4 showing the base completely closed;

DETAILED DESCRIPTION OF THE PREFERRED EMBODIMENTS

Figure 3:
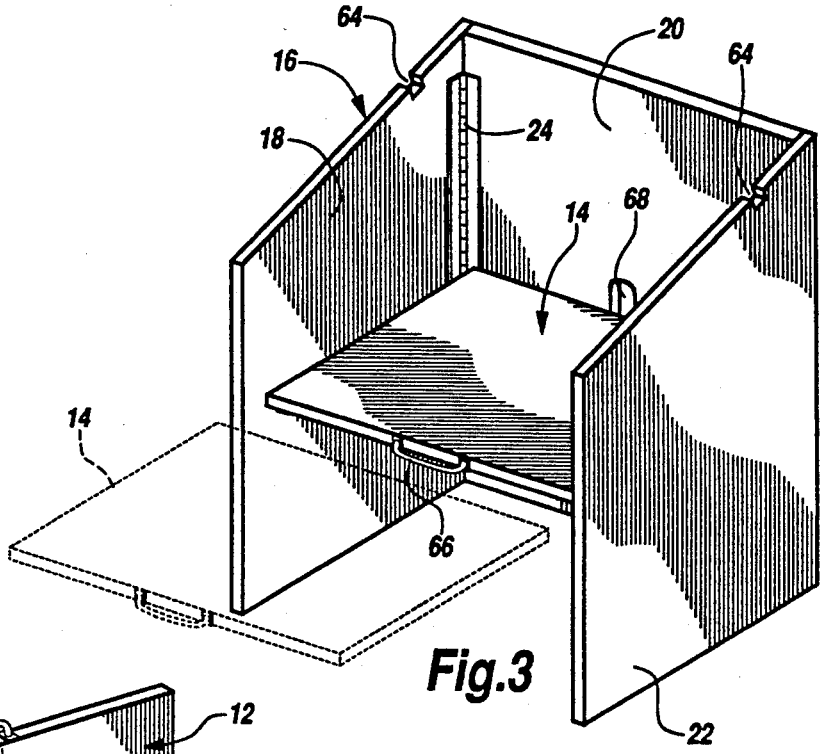
FIG. 3 is a perspective view showing the removal of the drafting table shelf.
Figure 6:
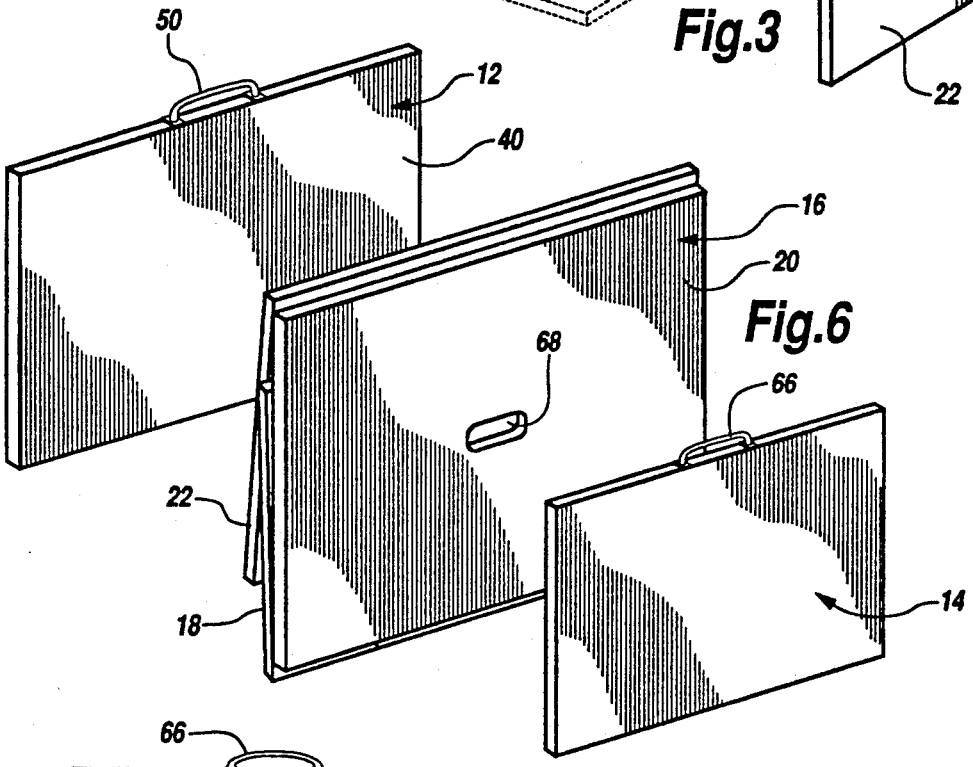
FIG. 6 is an exploded perspective view of the folding portable drafting table completely unassembled.

FIG. 1 shows a folding portable drafting table generally designated by the reference numeral 10 used to support art and drafting work. The table includes a top 12, shelf 14, and base 16.

Figure 8:
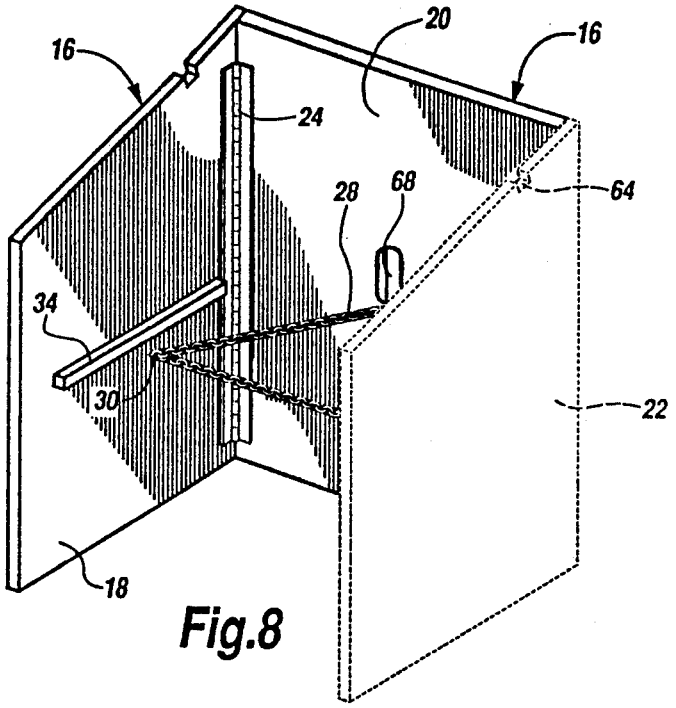
FIG. 8 is an enlarged perspective view of the drafting table base with one of the side panels shown in phantom.
Figure 9:
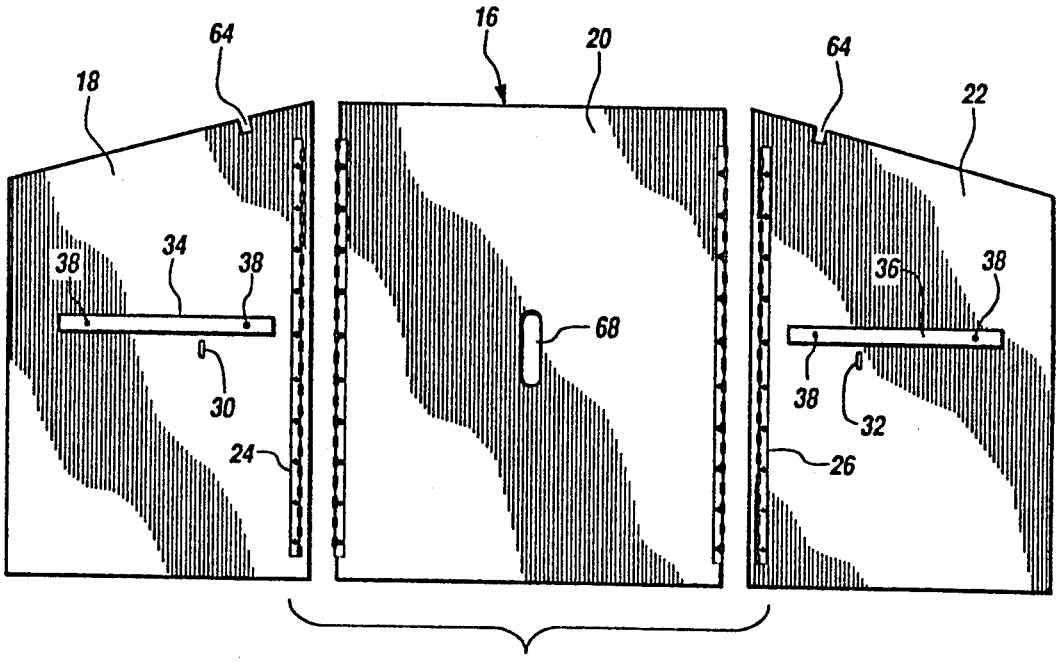
FIG. 9 is an exploded front view of the components of the drafting table base.

The base 16 can best be seen in FIGS. 8 and 9. Referring now to FIG. 8, the base 16 is comprised of a left side panel 18, a center panel 20, and a right side panel 22. The left and right panels 18 and 22 are joined respectively to the center panel 20, by piano hinges 24 and 26. The upper edges of each of the side panels 18 and 22 of the base 16 are angled so that table top 12 is positioned at an angle to facilitate drafting or working thereon. A chain 28 connects panels 18, 20 and 22 and limits the width of the base by having one end secured to center panel 20 and being attached along its length to each of the side panels 18 and 22 by means of chain anchors 30 and 32.

Figure 7:
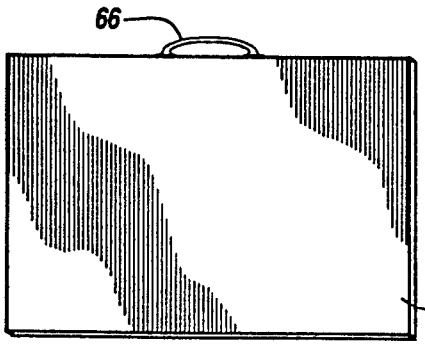
FIG. 7 is a perspective view of the drafting table shelf.

The shelf 14, which is shown more clearly in FIG. 7, is supported by shelf brackets 34 and 36 located on the left and right panels 18 and 22, respectively. Each shelf bracket is secured to the respective panel by shelf bracket screws 38. The shelf 14 serves as a shelf and as a means to prevent undesirable inward angular movements of side panels 18 and 22 of base 16. This combination of the chain 28 and the shelf 14 contributes to the stability of the drafting table 10 by increasing the number of horizontal angular restraints.

Figure 10:
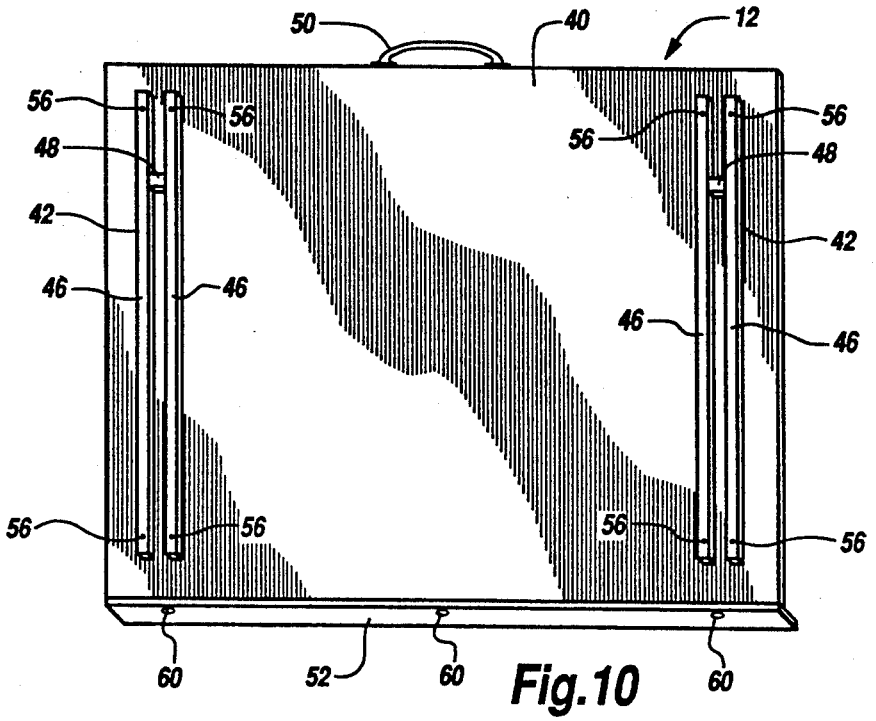
FIG. 10 is a perspective view of the bottom of the drafting table top.
Figure 11:
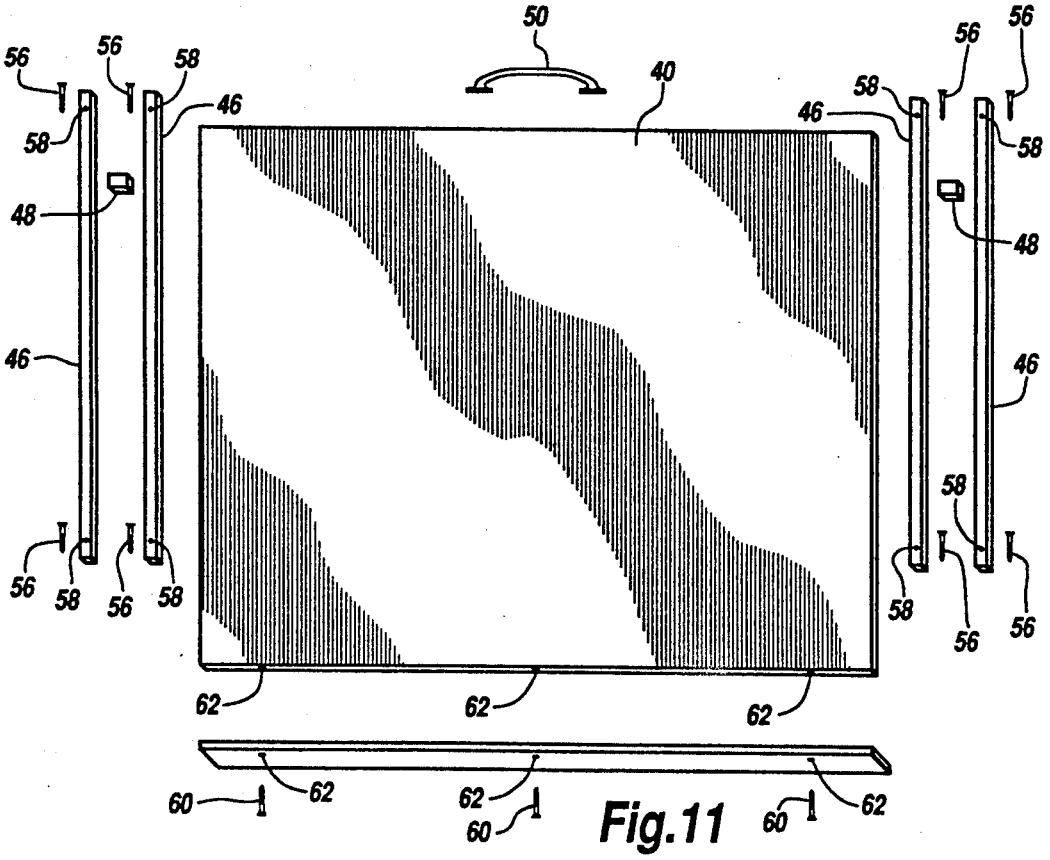
FIG. 11 is an exploded perspective bottom view showing the components of the drafting table top.

Referring now to FIGS. 10 and 11, it will be seen that the drafting table top 12 includes a drafting board 40, two pairs 42 and 44 of rails 46, two notch blocks 48, a handle 50, and a pencil tray 52. As can be seen in FIG. 2, the top 12 fits over the drafting table base 16 to form drafting table 10.

The drafting top 12 is held in place by rail pairs 42 and 44 which are located on the underside 54 of the drafting board 40 on the left and right hand sides thereof. The rails 46 are spaced apart by notch blocks 48 and run generally parallel to one another, almost the entire length of the drafting board 40. The rails 46 are attached to the drafting board 40 by wood screws 56 which are received in screw holes 58 (FIG. 11).

A further refinement of the drafting top 12 is the carrying handle 50 for facilitating assembly and disassembly as well as portability of the top 12. The pencil tray 52 is attached to the bottom of the drafting board 40 by wood screws 60 received in screw holes 62.

The coupling of the drafting table top 12 with the drafting table base 16 is by placing the rail pairs 42 and 44 over the tops of the left and right side panels 18 and 22 with the notch blocks 48 received in corresponding notches 64 in the upper surface of panels 18 and 22.

The shelf 14 is dimensioned to rest atop shelf brackets 34 with the top 12 positioned on the upper surface of panels 18, 20, and 22. Shelf 14 includes a carrying handle 66 to facilitate insertion and removal of the shelf as well as transportation of the table components.

The portability aspects of the present invention are most clearly illustrated in FIGS. 2–6 whereby the drafting table 10 is completely disassembled into three separate easily portable components 12, 14, and 16. The disassembled drafting table 10 results in drafting table shelf 14 which is easily transported by means of shelf carrying handle 66, drafting top 12 with carrying handle 50, and drafting table base 16 which is transported by means of a hand hole 68 cut into the center panel 20 of the drafting table base 16. The step required to disassemble the top 12 from the drafting table 10 is simply an upward vertical movement (FIG. 2). Next, drafting table shelf 14 is removed by a simple horizontal pulling motion which removes the shelf from the base 16 as illustrated in FIG. 3.

The drafting table base 16 then folds as is shown in FIGS. 4 and 5, with the left panel 18 folding inward toward the center panel 20 followed by the same folding movement of right panel 22. The disassembly of table 10 results in the three separate, easily transportable components shown in FIG. 6.

In accordance with a particular example of the present invention, the folding portable drafting table includes a foldable base, a top, and a shelf, all made of light-weight wood or other material. The shelf has length and width dimensions of about twenty inches by thirty-two and one-half inches and a carrying handle about four and one-half inches wide. The base includes a center panel having height and width dimensions of about forty inches by thirty-three inches and is connected to right and left side panels by one inch wide piano hinges having a length of about thirty-six inches. Each of the right and left side panels has a width of about twenty-four inches, a height adjacent the central panel of about forty inches and a height at their forward edge of about thirty-three inches with the upper angled surface of each side panel including a one inch notch adapted to receive a block on the underside of the top. The top has length and width dimensions of about twenty-four inches by thirty-six inches, includes a four and one-half inch wide carrying handle, two pairs of rails with each rail about five-eighths inch in width and less than twenty-four inches in length, two seven-eighths inch notch blocks, and a pencil tray having a length of about thirty-six inches.

Thus, it will be appreciated that as a result of the present invention, a highly effective improved folding portable drafting table is provided by which the objective is completely fulfilled. It is contemplated and will be apparent to those skilled in the art from the preceding description and accompanying drawings that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

I claim:

1. A folding portable drafting table comprising:

a base having a center panel, a left panel, and a right panel, said center panel being of elongated rectangular outline with the vertical length being longer than the horizontal width, said left and right panels being of substantially trapezoidal elongated outline, each having a top and bottom and a front and back edge, said back edge being approximately the same vertical length as said vertical length of said center panel and said front edge being smaller in vertical length than said back edge, and said top edge including a notch, means for rotatably securing said back edge of said left and right panels to said center panel, said means extending substantially the entire continuous vertical length of said center panel, means for limiting the angular rotation of said left and right panels with respect to said center panel, a table top having an elongated rectangular outline and a combination of rails and blocks on the underside of said table top, said combination of rails and blocks providing for securing said table top to said top edges of said left and right panels and extending substantially the entire length of said top edges of said left and right panels, and said blocks being adapted to be received by said notches in said top edges of said right and left panels.

2. The table as recited in claim 1 wherein said table top further comprises at least one handle located near the midpoint of a top edge of said table top and also having a raised edge extending substantially the entire length of a lowermost edge of said table top.

3. The table as recited in claim 1 wherein said means for limiting the angular rotation of said left and right panels with respect to said center panel comprises an anchor chain attached near the midpoint of said left, right and center panels.

4. The table as recited in claim 3 wherein said means for limiting further comprises a shelf of elongated rectangular shape adapted to be received between said left and right panels with said table top placed over said base.

5. The table as recited in claim 1 wherein said means for limiting comprises a shelf of elongated rectangular shape adapted to fit between said left and right panels with said table top placed over said base.

6. The table as recited in claim 5 wherein said shelf includes a handle located on one edge thereof.

7. The table as recited in claim 6 wherein said base, said table top, and said shelf are adapted to be assembled into a usable table and disassembled into three portable pieces quickly and easily without tools.

8. The table as recited in claim 6 wherein each of said left and right panels include shelf brackets extending from an inner surface thereof for supporting said shelf.

9. The table as recited in claim 8 wherein said table top, shelf and base are made of light-weight materials.

10. The table as recited in claim 1 wherein said center panel of said base includes a hand hold.

* * * * *